US012129739B1

(12) United States Patent
Edwards et al.

(10) Patent No.: US 12,129,739 B1
(45) Date of Patent: Oct. 29, 2024

(54) SEQUESTRATION INJECTION VALVE, METHOD, AND SYSTEM

(71) Applicant: Baker Hughes Oilfield Operations LLC, Houston, TX (US)

(72) Inventors: Jason Edwards, Tulsa, OK (US); John Burris, Bixby, OK (US); Ronald J. Garr, Inola, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/318,130

(22) Filed: May 16, 2023

(51) Int. Cl.
*E21B 34/14* (2006.01)
*E21B 41/00* (2006.01)

(52) U.S. Cl.
CPC ..... *E21B 34/14* (2013.01); *E21B 41/0057* (2013.01); *E21B 2200/06* (2020.05)

(58) Field of Classification Search
CPC ... E21B 34/14; E21B 41/0057; E21B 2200/06
See application file for complete search history.

(56) References Cited

U.S. PATENT DOCUMENTS

| | | | | |
|---|---|---|---|---|
| 4,355,685 | A | 10/1982 | Beck | |
| 5,318,120 | A | 6/1994 | Hisaw | |
| 7,416,029 | B2 | 8/2008 | Telfer et al. | |
| 8,607,811 | B2 | 12/2013 | Kormaz | |
| 8,733,474 | B2 * | 5/2014 | Nikiforuk | E21B 34/063 175/57 |
| 9,217,312 | B2 * | 12/2015 | Hill, Jr | E21B 34/10 |
| 9,624,755 | B2 | 4/2017 | Hill, Jr. et al. | |
| 10,018,022 | B2 * | 7/2018 | Mailand | E21B 34/14 |
| 11,414,956 | B1 * | 8/2022 | Burris | E21B 43/12 |
| 2003/0102131 | A1 * | 6/2003 | Wenzel | E21B 21/106 166/325 |
| 2005/0263279 | A1 | 12/2005 | Vachon | |
| 2009/0084556 | A1 | 4/2009 | Richards et al. | |

(Continued)

FOREIGN PATENT DOCUMENTS

WO 2013148015 A1 10/2013

OTHER PUBLICATIONS

International Search Report and Written Opinion; PCT/US2023/017562; Korean Intellectual Property Office; Mailed Jul. 19, 2023; 12 pages.

(Continued)

*Primary Examiner* — Aaron L Lembo
(74) *Attorney, Agent, or Firm* — CANTOR COLBURN LLP

(57) ABSTRACT

A sequestration injection valve including a housing, a flow valve disposed in the housing, an injector assembly, the assembly having a ported inner sleeve and a ported outer sleeve, the inner sleeve and outer sleeve moveable relative to one another to more align or more misalign the ports in the inner sleeve and outer sleeve. A method for injecting sequestration fluid into a borehole including applying pressure to a flow valve in an injection valve, moving an inner sleeve of an injector assembly with the pressure, and automatically maintaining pressure differential at the injector assembly. A borehole system including a borehole in a subsurface formation, a string in the borehole, and a sequestration injection valve disposed within or as a part of the string.

15 Claims, 2 Drawing Sheets

(56) References Cited

U.S. PATENT DOCUMENTS

| | | | | |
|---|---|---|---|---|
| 2010/0044054 | A1 | 2/2010 | De Boer | |
| 2013/0043045 | A1 | 2/2013 | Swietlik et al. | |
| 2014/0262265 | A1 | 9/2014 | Hutchins et al. | |
| 2014/0345880 | A1 | 11/2014 | Enis et al. | |
| 2015/0361763 | A1* | 12/2015 | Mailand | E21B 34/10 166/321 |
| 2017/0292347 | A1 | 10/2017 | Mailand et al. | |
| 2018/0142534 | A1 | 5/2018 | Mailand et al. | |
| 2018/0313189 | A1 | 11/2018 | Hill, Jr. et al. | |
| 2018/0334883 | A1 | 11/2018 | Williamson | |
| 2019/0162049 | A1 | 5/2019 | Woie | |
| 2020/0292083 | A1* | 9/2020 | Park | E21B 34/08 |
| 2023/0323752 | A1 | 10/2023 | Burris | |

OTHER PUBLICATIONS

Notification of Transmittal of the International Search Report and the Written Opinion of the International Searching Authority, or the Declaration; PCT/US2022/070863; Mail date: Jun. 7, 2022: 11 pages.

* cited by examiner

SEQUESTRATION INJECTION VALVE, METHOD, AND SYSTEM

BACKGROUND

In the fluid sequestration industry fluids are generally injected into subsurface formations at high pressure and sometimes in liquified form. This supports efficiency in injection but creates the issue of the sequestration potentially flashing and cooling the local area. Such cooling can deleteriously affect the injection valve and reduce overall efficiency of the operation. The art would well receive alternatives that instead increase efficiency.

SUMMARY

An embodiment of a sequestration injection valve including a housing, a flow valve disposed in the housing, an injector assembly, the assembly having a ported inner sleeve and a ported outer sleeve, the inner sleeve and outer sleeve moveable relative to one another to more align or more misalign the ports in the inner sleeve and outer sleeve.

An embodiment of a method for injecting sequestration fluid into a borehole including applying pressure to a flow valve in an injection valve, moving an inner sleeve of an injector assembly with the pressure, and automatically maintaining pressure differential at the injector assembly.

An embodiment of a borehole system including a borehole in a subsurface formation, a string in the borehole, and a sequestration injection valve disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
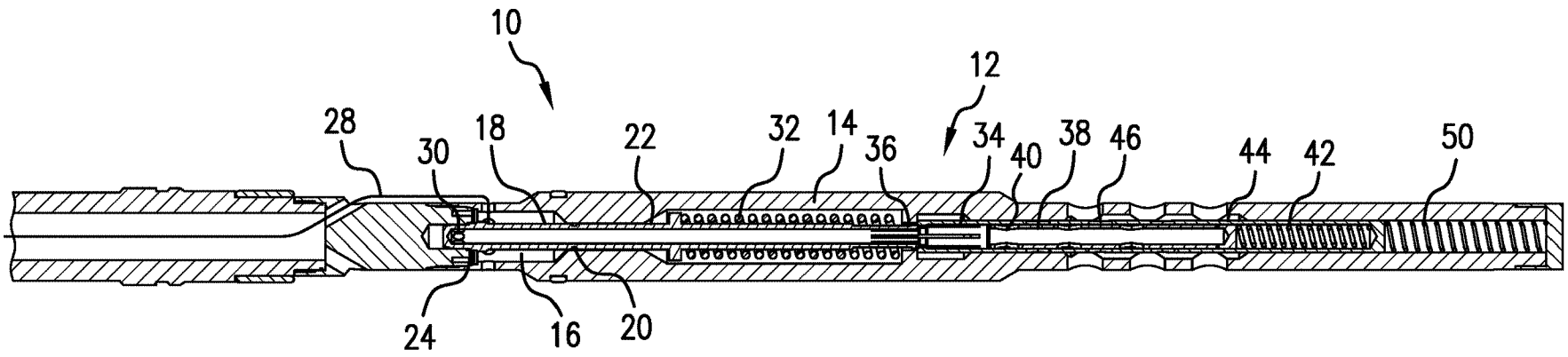
FIG. 1 is a cross sectional view of a sequestration injection valve as disclosed herein.

Referring to FIG. 1, a sequestration injection valve 10 is illustrated. The valve 10 is configured to ensure a constant differential pressure at an injector assembly 12 thereof during all flow rates through the valve 10. Maintaining differential pressure controls the tendency to flash the injection fluid, which is undesirable since flashing the injection fluid causes a marked local temperature drop and potential freezing of the valve.

Connected to the injector assembly 12 is a housing 14 that contains a flow valve 16 therein. Flow valve 16 comprises a vent stem 18 that includes a dynamic seal 20 on an outside surface 22 of the vent stem 18. The vent stem 18 also includes a second seal 24, that may be any type of seal including a metal-to-metal seal. Each seal 20 and 24 is interactive with the housing 14 to seal a flow path 28 (see arrows) through the housing when the flow valve 16 is closed. The vent stem 18 further includes a port 30 therein that intersects the flow path 28 allowing fluid from flow path 28 into the vent stem 18 when the seal 24 is not sealed to the housing 14. It is to be appreciated that the seal area of seal 24 is smaller than the seal area of seal 20 and hence pressure applied through flow path 28 will cause the vent stem 18 to move to the right of the figure, thereby opening the valve 16. Movement of the vent stem 18 in this direction is against the bias of a spring 32 that biases the valve 16 to a closed position.

Returning to the injector assembly 12, it will be appreciated from FIG. 1 that the vent stem 18 is positioned to supply injector assembly 12 with fluid from the flow path 28 when valve 16 is open. That fluid is the sequestration fluid. When pressure is raised in the sequestration fluid in flow path 28, the vent stem 18 will move, both opening the valve 16 and engaging the vent stem 18 with an engagement neck 34 of the injector assembly 12. In one embodiment, the engagement neck 34 is a collet and the vent stem includes an engagement profile 36 to be engaged with the collet. Regardless of specific construction of the neck 34, the function is that the neck 34 will releasably attach the injection assembly 12 to the vent stem 18. The purpose of the attachment relates to the closure of the valve 16. The engagement is so that when flow rate/pressure of the sequestration fluid falls, the valve 16 will not hover between open and closed. This behavior could reduce service life of the seals. Rather, due to the neck 34, the vent stem 18 is held back from closing until the fall off in flow or pressure in the flow path 28 is well below that required to open the valve 16. The valve 16 hence tends to snap closed at this point after the spring 32 biases the vent stem 18 more than the neck 34 holds the vent stem 18. The neck will release at this point and the valve 16 will decisively close.

While the valve 16 is open and the vent stem is engaged with neck 34, sequestration fluid will flow into the injector assembly 12. Sequestration fluid will flow into an inner sleeve 38 having a port 40 therein. Pressure of the fluid in the inner sleeve 38 biases inner sleeve 38 against a spring 42 that is disposed between the inner sleeve 38 and an outer sleeve 44, the outer sleeve 44 having its own port 46. The greater the flow rate/pressure of the sequestration fluid, the more the spring 42 is compressed. The more the spring 42 is compressed, the more aligned ports 40 and 46 will be.

Review of FIG. 1 will show that port 46 and port 40 are not aligned when the valve 16 is closed, but become more and more aligned with the degree of openness of the valve 16 (which is directly related to flow rate/pressure of the sequestration fluid in the fluid pathway 28). The greater the flow rate/pressure of the sequestration fluid, the more the ports 40 and 46 are aligned. It is the degree of alignment of the ports 40 and 46 that ensures a constant pressure differential for the sequestration fluid flowing through the valve 10. Further, in an embodiment, the ports 40 and 46 are shaped as ovals so that a small degree of overlap will produce a small flow orifice while a small increase in overlap of the ports 40/46 will create a more than linear increase in the size of the resulting orifice. This configuration helps maintain constant pressure differential regardless of flow rate of sequestration fluid. The spring 42 is selected with a spring constant that supports the desired pressure differential. Specifically, spring 42 is ideally a constant force spring mechanism but could also be satisfied by a spring with an acceptably low spring rate over the range of travel.

Further, in an embodiment, the injector assembly 12 is connected to the housing 14 by a spring 50. The spring 50 returns and holds outer sleeve 44 to the closed position. The spring 50 need only provide force necessary to lift the combined mass of outer sleeve 44, inner sleeve 38, and spring 42, independent of pressure effects on vent stem 18.

The spring 50 is shown as compression spring but it is understood that a tension spring or other actuation method would accomplish the same purpose.

Figure 2:
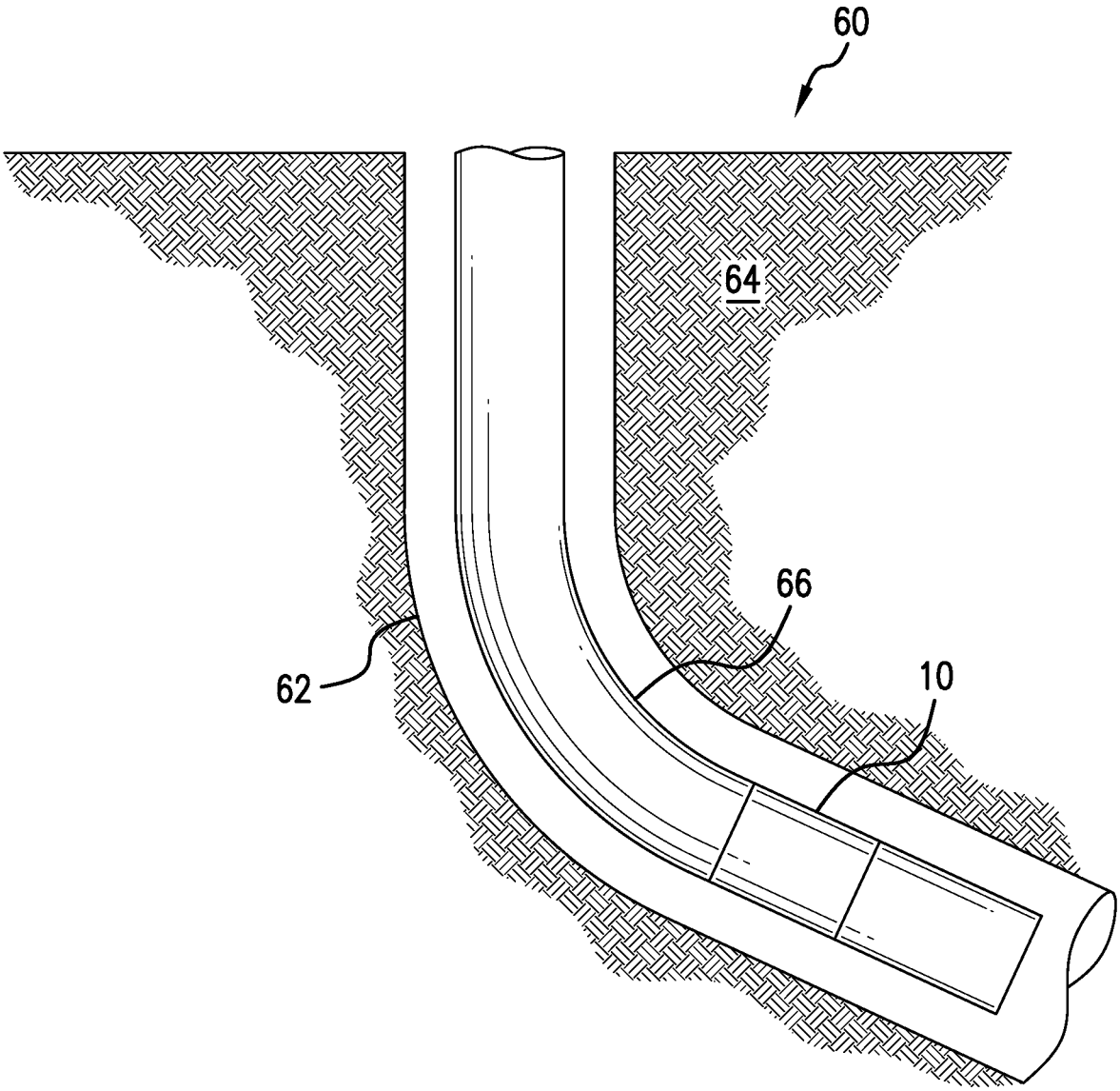
FIG. 2 is a schematic view of a borehole system including the sequestration injection valve disclosed herein.

Referring to FIG. 2, a borehole system 60 is illustrated. The system 60 comprises a borehole 62 in a subsurface formation 64. A string 66 is disposed within the borehole 62. A sequestration fluid injection valve 10 as disclosed herein is disposed within or as a part of the string 66.

Set forth below are some embodiments of the foregoing disclosure:

Embodiment 1: A sequestration injection valve including a housing, a flow valve disposed in the housing, an injector assembly, the assembly having a ported inner sleeve and a ported outer sleeve, the inner sleeve and outer sleeve moveable relative to one another to more align or more misalign the ports in the inner sleeve and outer sleeve.

Embodiment 2: The valve as in any prior embodiment, wherein the injector assembly includes a spring to overcomably maintain the inner sleeve and outer sleeve in a port misaligned position.

Embodiment 3: The valve as in any prior embodiment, wherein the flow valve is biased closed by a spring in the housing.

Embodiment 4: The valve as in any prior embodiment, wherein the flow valve includes seal areas that cause the valve to open upon pressure increase upstream of the valve, during use.

Embodiment 5: The valve as in any prior embodiment, wherein the flow valve includes a vent stem.

Embodiment 6: The valve as in any prior embodiment, wherein the vent stem includes an engagement profile.

Embodiment 7: The valve as in any prior embodiment, wherein the engagement profile is engageable with the outer sleeve.

Embodiment 8: The valve as in any prior embodiment, wherein the outer sleeve includes a collet to engage the profile.

Embodiment 9: The valve as in any prior embodiment, wherein the injector assembly is resiliently attached to the housing.

Embodiment 10: The valve as in any prior embodiment, wherein the injector assembly is attached to the housing with a tension spring.

Embodiment 11: The valve as in any prior embodiment, wherein the injector assembly further includes a spring biasing the inner sleeve port to a position that is unaligned with the outer sleeve port.

Embodiment 12: A method for injecting sequestration fluid into a borehole including applying pressure to a flow valve in an injection valve, moving an inner sleeve of an injector assembly with the pressure, and automatically maintaining pressure differential at the injector assembly.

Embodiment 13: The method as in any prior embodiment, further including adjusting an overlap of ports in an inner sleeve and an outer sleeve of the injector assembly.

Embodiment 14: The method as in any prior embodiment, further including physically engaging a vent sleeve of the flow valve with the injector assembly.

Embodiment 15: The method as in any prior embodiment, further including physically disengaging a vent sleeve of the flow valve from the outer sleeve of the injector assembly upon applied pressure reduction thereby snapping the flow valve closed.

Embodiment 16: A borehole system including a borehole in a subsurface formation, a string in the borehole, and a sequestration injection valve as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A sequestration injection valve comprising:

a housing;

a flow valve disposed in the housing, the flow valve including a vent stem;

an injector assembly, the assembly having a ported inner sleeve and a ported outer sleeve, the inner sleeve and outer sleeve moveable relative to one another to more align or more misalign the ports in the inner sleeve and outer sleeve.

2. The valve as claimed in claim 1, wherein the injector assembly includes a spring to overcomably maintain the inner sleeve and outer sleeve in a port misaligned position.

3. The valve as claimed in claim 1, wherein the flow valve is biased closed by a spring in the housing.

4. The valve as claimed in claim 1, wherein the flow valve includes seal areas that cause the valve to open upon pressure increase upstream of the valve, during use.

5. The valve as claimed in claim 1, wherein the vent stem includes an engagement profile.

6. The valve as claimed in claim 5, wherein the engagement profile is engageable with the outer sleeve.

7. The valve as claimed in claim 5, wherein the outer sleeve includes a collet to engage the profile.

8. The valve as claimed in claim 1, wherein the injector assembly is resiliently attached to the housing.

9. A sequestration injection valve comprising:

a housing;

a flow valve disposed in the housing;

an injector assembly, the assembly having a ported inner sleeve and a ported outer sleeve, the inner sleeve and outer sleeve moveable relative to one another to more align or more misalign the ports in the inner sleeve and outer sleeve, wherein the injector assembly is attached to the housing with a tension spring.

10. The valve as claimed in claim 1, wherein the injector assembly further includes a spring biasing the inner sleeve port to a position that is unaligned with the outer sleeve port.

11. A method for injecting sequestration fluid into a borehole comprising:

applying pressure to a flow valve in an injection valve;

moving the inner sleeve of the injector assembly as claimed in claim 1 with the pressure; and automatically maintaining pressure differential at the injector assembly.

12. The method as claimed in claim 11, further including adjusting an overlap of ports in an inner sleeve and an outer sleeve of the injector assembly.

13. The method as claimed in claim 11, further including physically engaging a vent sleeve of the flow valve with the injector assembly.

14. The method as claimed in claim 11, further including physically disengaging a vent sleeve of the flow valve from the outer sleeve of the injector assembly upon applied pressure reduction thereby snapping the flow valve closed.

15. A borehole system comprising:

a borehole in a subsurface formation;

a string in the borehole; and a sequestration injection valve as claimed in claim 1 disposed within or as a part of the string.

* * * * *